US009750313B2

(12) United States Patent
Keyaki et al.

(10) Patent No.: US 9,750,313 B2
(45) Date of Patent: Sep. 5, 2017

(54) SLIDER FOR SLIDE FASTENER, AND SLIDE FASTENER

(71) Applicant: YKK Corporation, Tokyo (JP)

(72) Inventors: Keiichi Keyaki, Toyama (JP); Takanori Ozawa, Toyama (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 15/030,545

(22) PCT Filed: Dec. 25, 2013

(86) PCT No.: PCT/JP2013/084738
§ 371 (c)(1),
(2) Date: Apr. 19, 2016

(87) PCT Pub. No.: WO2015/097793
PCT Pub. Date: Jul. 2, 2015

(65) Prior Publication Data
US 2016/0262502 A1 Sep. 15, 2016

(51) Int. Cl.
*A44B 19/26* (2006.01)
*A44B 19/02* (2006.01)

(52) U.S. Cl.
CPC ..... *A44B 19/26* (2013.01); *A44B 19/02* (2013.01); *Y10T 24/2582* (2015.01)

(58) Field of Classification Search
CPC ..... A44B 19/24; A44B 19/26; A44B 19/02; Y10T 24/2582; Y10T 24/2561;
(Continued)

(56) References Cited

U.S. PATENT DOCUMENTS 2,568,163 A * 9/1951 Morin ..... A44B 19/26 24/428
4,525,903 A * 7/1985 Ishii ..... A44B 19/26 24/429

(Continued)

FOREIGN PATENT DOCUMENTS

JP 10-042914 A 2/1998
JP 63-033527 Y2 9/1998

(Continued)

OTHER PUBLICATIONS

International Search Report, PCT Application No. PCT/JP2013/084738, mailed Apr. 15, 2014.

(Continued)

*Primary Examiner* — Abigail Troy
(74) *Attorney, Agent, or Firm* — Kilpatrick Townsend & Stockton LLP

(57) ABSTRACT

A slider for slide fastener has a slider body in which an upper wing and a lower wing are coupled via a coupling pillar at the front side. At the front part of the upper wing, provided is a downward slope descending toward the lower wing as extending away from a front mouth toward a back mouth of the slider body. At the front part of the lower wing, provided is an upward slope ascending toward the upper wing as extending away from the front mouth toward the back mouth of the slider body. The downward slope of the upper wing is steeper than the upward slope of the lower wing.

9 Claims, 6 Drawing Sheets

(58) Field of Classification Search
CPC ..... Y10T 24/2563; Y10T 24/2564; Y10T 24/2566; Y10T 24/2568; Y10T 24/257; Y10T 24/2573; Y10T 24/2575; Y10T 24/2577; Y10T 24/2579; Y10T 24/258; Y10T 24/2584; Y10T 24/2586; Y10T 24/2588; Y10T 24/2589
See application file for complete search history.

(56) References Cited

U.S. PATENT DOCUMENTS

| | | | | |
|---|---|---|---|---|
| 4,590,648 | A * | 5/1986 | Yoshida | A44B 19/26 24/415 |
| 4,827,580 | A * | 5/1989 | Yaguramaki | A44B 19/305 24/419 |
| 5,809,622 | A | 9/1998 | Yaguramaki | |
| 2005/0076481 | A1 | 4/2005 | Lin | |
| 2006/0075611 | A1 | 4/2006 | Yamagishi et al. | |
| 2014/0130315 | A1 | 5/2014 | Keyaki et al. | |

FOREIGN PATENT DOCUMENTS

| | | | |
|---|---|---|---|
| JP | 2006-102286 | A | 4/2006 |
| WO | 2012/070136 | A1 | 5/2012 |
| WO | 2012/172692 | A1 | 12/2012 |

OTHER PUBLICATIONS

International Preliminary Report on Patentability, PCT Application No. PCT/JP2013/084738, mailed Jul. 7, 2016.

* cited by examiner

SLIDER FOR SLIDE FASTENER, AND SLIDE FASTENER

This application is a national stage application of PCT/JP2013/084738, which is incorporated herein by reference.

TECHNICAL FIELD

The present disclosure is directed to a slider for a slide fastener in which an up-down distance between an upper wing and a lower wing is decreased at a front mouth side by an upper slope and a bottom slope, and is directed to a slide fastener including such a slider.

BACKGROUND ART

Patent literature 1 discloses, as shown in its FIGS. 2 and 3, the respective edges of upper plate 11 and lower plate 12 are projected forward relative to the center point 20 of the coupling pillar 13, and this projected portions are provided with slopes 23, 24 respectively at the inner surface. This literature describes that such configuration as explained above may serve to avoid an associated problem when a slider for slide fastener is utilized which is configured as illustrated in FIG. 1 of this document, i.e. the coupling head of the fastener element may hit the upper plate due to its tumbling to disrupt the movement of slider, so that easier movement of slider may be facilitated. In the slider for slide fastener of FIG. 1 of this literature, the coupling pillar 3 is projected forward as illustrated and the edges of the upper and lower plates are receded.

In Patent literature 2, as shown in its FIGS. 1 and 2, a slider for slide fastener is disclosed in which each of the upper and lower plates is provided with a slope 20, 20' that is provided as illustrated in FIGS. 1 and 2. This literature states from its line 45, column 2 that slopes 20, 20' are steeper at the coupling pillar 15 side, and the steepness decreases toward the flange 13. Further explained is that, by providing such a slider's slope, elements may be rotated to take a suitable orientation, and may smoothly enter into the respective openings so that independent easier coupling may be ensured.

CITATION LIST

Patent Literature

[PTL 1] Japanese Examined Utility Model No. 63-33527
[PTL 2] U.S. Pat. No. 2,568,163

SUMMARY OF INVENTION

Technical Problem

Due to the stitching manner of a fastener tape, left and right fastener elements may be out of a parallel aligned state in which left and right fastener elements are placed adjacent in a coplanar and the respective front part 111 surfaces of the fastener elements are aligned one another in parallel. Instead, the left and right fastener elements may be in a non-parallel state in which, from such parallel aligned state, the left and right fastener elements are rotated at any given angle toward the same side of the up-down direction and toward the opposite side of the left-right direction, and the respective front part 111 surfaces of the fastener elements are arranged one another in non-parallel. Sometimes, smoothly closing such a slide fastener in the non-parallel state may be required. As a non-exclusive and exemplary example, when the fastener tape were to stitched to a leather of a given thickness and having lower flexibility than a common web fastener tape, the orientation of the fastener element may tend to follow the orientation of that leather part to which the fastener tape was stitched. This could be more evident if the left-right interspace between the fastener element line and the leather becomes narrower. This may be because the benefit of the flexibility of fastener tape may not be enjoyed, if the interspace between the fastener element line and the leather is narrower. Note that, aesthetic effect of decreased exposure of fastener tape may be obtained in accordance with the decrease of the interspace between the fastener element line and the leather.

An example will be presented just to facilitate a better understanding. It is assumed that a slide fastener is not arranged for two leathers arranged in the same 1st plane, but is arranged onto the upper edges of two leathers arranged in 2nd and 3rd planes which are orthogonal to the first plane and separated one another. If the 1st plane laterally extends and the 2nd and 3rd planes longitudinally extend, the fastener elements may be oriented similarly longitudinally in accordance with the leather's longitudinal orientation. If a conventional slider for slide fastener was used to close such a slide fastener, the upper wing of the slider may hit against such longitudinally oriented fastener elements thereby smoothly closing the slide fastener would be not possible. This would similarly apply if the sliders for slide fastener disclosed in the patent literatures 1 and 2 were used.

The present inventor has newly discovered a technical problem for supplying a slider for slide fastener which may allow various stitching manners of fastener tape. Note that "various stitching manners of fastener tape" stated here may include a stitching manner in which the interspace between the fastener element line and the leather is narrow as described above, but may also include any other various stitching manners.

Solution to Problem

There is provided a slider for slide fastener according to an aspect of the present invention, the slider comprising a slider body (105) in which an upper wing (110) and a lower wing (120) are coupled via a coupling pillar (130) at the front side, and a passage for a pair of fastener elements (230) being divided by the coupling pillar (130) is provided between the upper wing (110) and the lower wing (120), wherein at a front part (111) of the upper wing (110), downward slopes (115) are provided at the both left and right sides of the coupling pillar (130), each downward slope (115) descending toward the lower wing (120) as extending away from a front mouth (106) toward a back mouth (107) of the slider body (105), wherein at the front part (121) of the lower wing (120), upward slopes (125) are provided at the both left and right sides of the coupling pillar (130), each upward slope (125) ascending toward the upper wing (110) as extending away from the front mouth (106) toward the back mouth (107) of the slider body (105), and wherein at each left and right side, the downward slope (115) of the upper wing (110) is steeper than the upward slope (125) of the lower wing (120).

$1.5 \leq \theta 1/\theta 2 \leq 2$ may preferably be satisfied, wherein $\theta 1$ indicates the angle of the downward slope (115) relative to a plane that is parallel to the inner surface of the passage in the slider body (105); and θ2 indicates the angle of the upward slope (125) relative to a plane that is parallel to the inner surface of the passage in the slider body (105).

The distance (TH115) between the top and bottom end points of the downward slope (115) along the thickness direction of the upper wing (110) may preferably be greater than the distance (TH125) between the top and bottom end points of the upward slope (125) along the thickness direction of the lower wing (120).

The length of the downward slope (115) may preferably be greater than the length of the upward slope (125).

The upper wing (110) may preferably comprise a pair of upper flanges that extend away from the front mouth (106) toward the back mouth (107) of the slider body (105) and restrict the fastener element (230) from the left and right sides, and wherein each downward slope (115) may be provided at a region between the coupling pillar (130) and each upper flange (118).

The lower wing (120) may preferably comprise a pair of lower flanges that extend away from the front mouth (106) toward the back mouth (107) of the slider body (105) and restrict the fastener element (230) from the left and right sides, and wherein each upward slope (125) may be provided at a region covering at least between the coupling pillar (130) and each lower flange (128).

There is provided a slide fastener according to another aspect of the present invention, the slide fastener comprising:

a slider (100) for slide fastener according to any one of above paragraphs, and a pair of fastener stringers (200) opened and closed by the slider (100) for slide fastener.

Advantageous Effects of Invention

According to the present invention, a slider for slide fastener may be supplied which may allow various stitching manners of fastener tape.

DESCRIPTION OF EMBODIMENTS

Hereinafter, exemplary embodiments of the present invention will be described with reference to drawings. Respective embodiments are not mutually exclusive, and the skilled person could properly combine them without requiring excess descriptions and could understand the synergic effect by such combination. Overlapping descriptions among embodiments will basically be omitted. Referenced drawings are mainly for the purpose of illustrating the invention and may be simplified in an appropriate manner.

Figure 2:
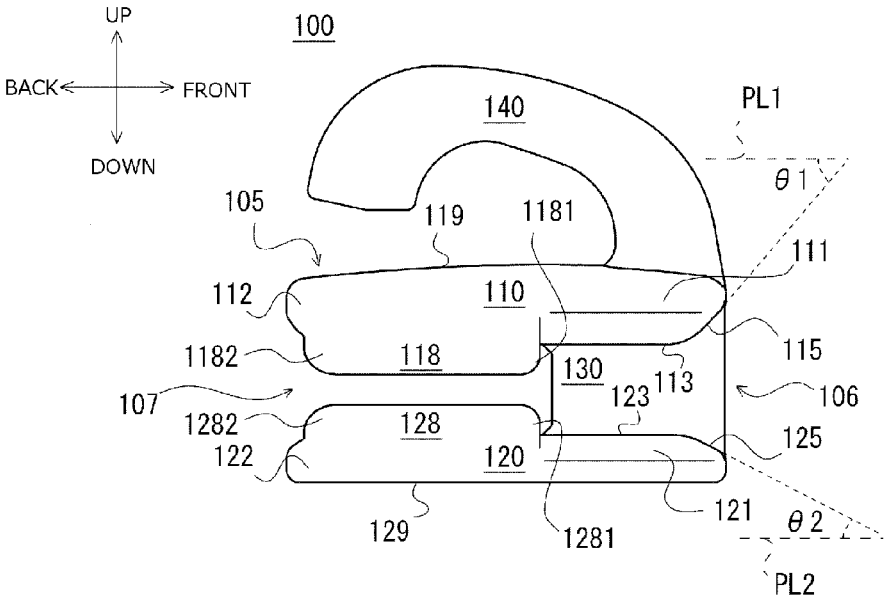
FIG. 2 is a schematic right side view of a slider for slide fastener according to the first embodiment of the present invention.
Figure 3:
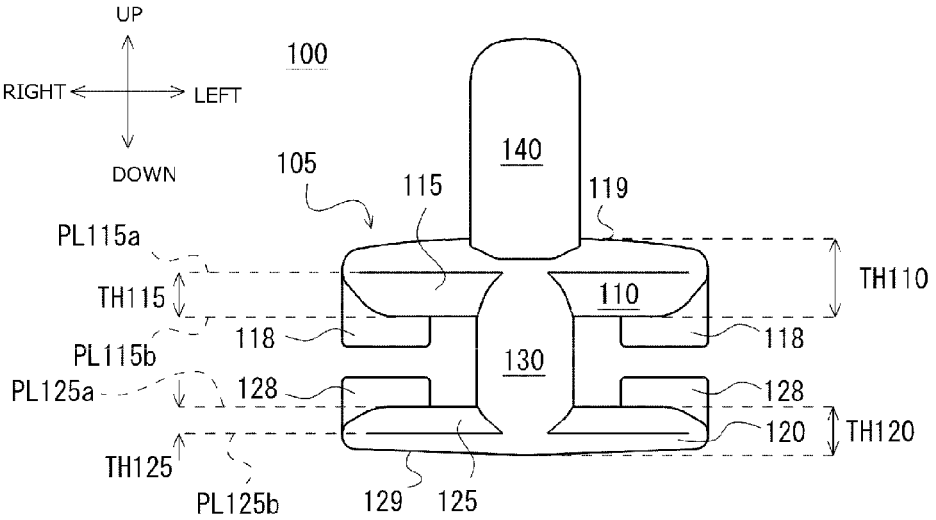
FIG. 3 is a schematic front side view of a slider for slide fastener according to the first embodiment of the present invention.

In the present specification, an up-down direction, a left-right direction, and a front-back direction are as illustrated in FIGS. 2 and 3. That is, the up-down direction is equal to the extending direction of a coupling pillar coupling an upper wing and a lower wing. Also, the up-down direction is equal to the side-by-side arrangement direction of the upper and lower wings being arranged in parallel. The left-right direction is orthogonal to the up-down direction. Two front mouths are arranged at the left and right sides of the coupling pillar. The front-back direction is orthogonal to the up-down direction and the left-right direction. Frontward is equal to a moving direction of a slider for slide fastener for closing a slide fastener. Backward is equal to a moving direction of a slider for slide fastener for opening a slide fastener. The thickness direction of the upper or lower wing is equal to the up-down direction. Note that, in descriptions below, a slider for slide fastener may be occasionally referred to as a slider.

First Embodiment

Figure 1:
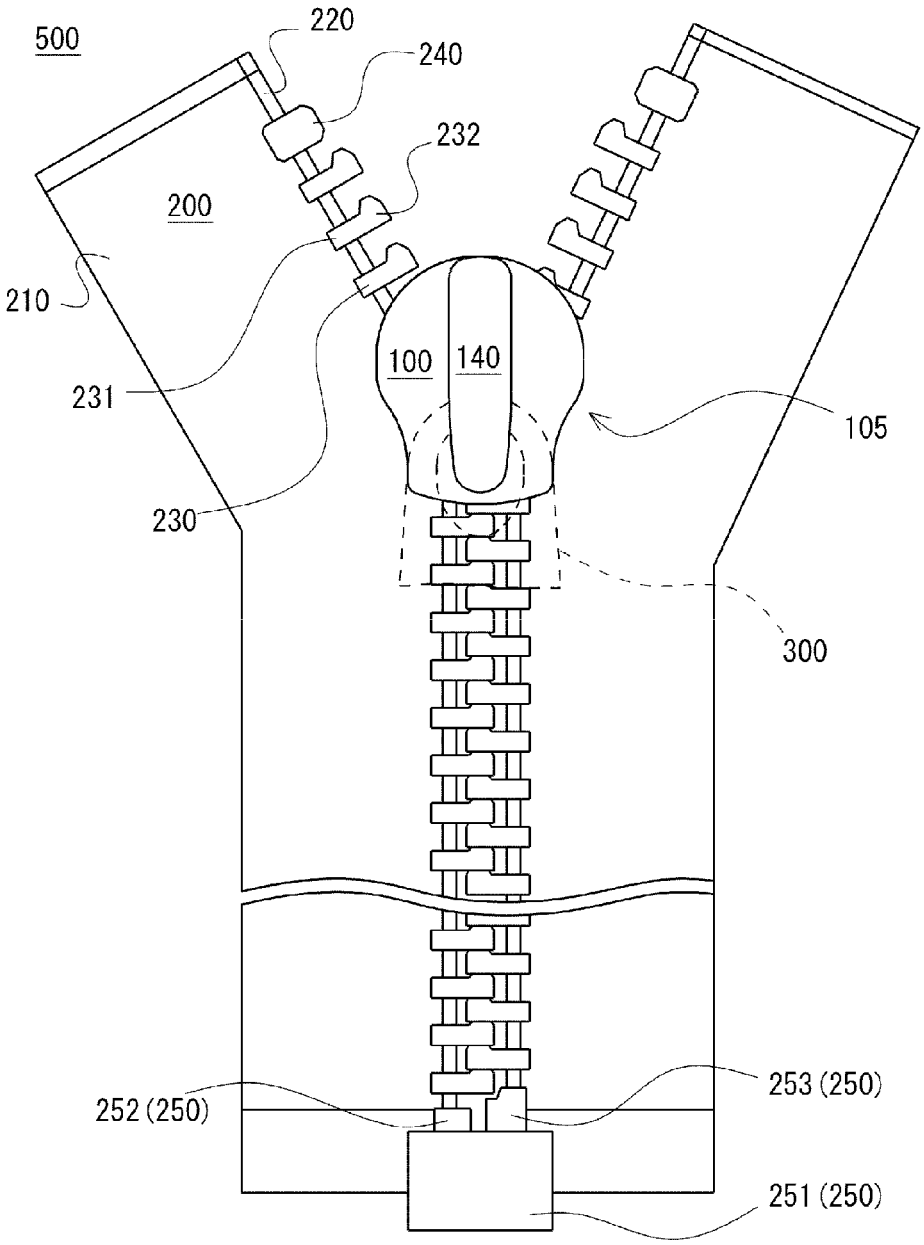
FIG. 1 is a schematic front view of a slide fastener including a slider for slide fastener according to a first embodiment of the present invention.
Figure 4:
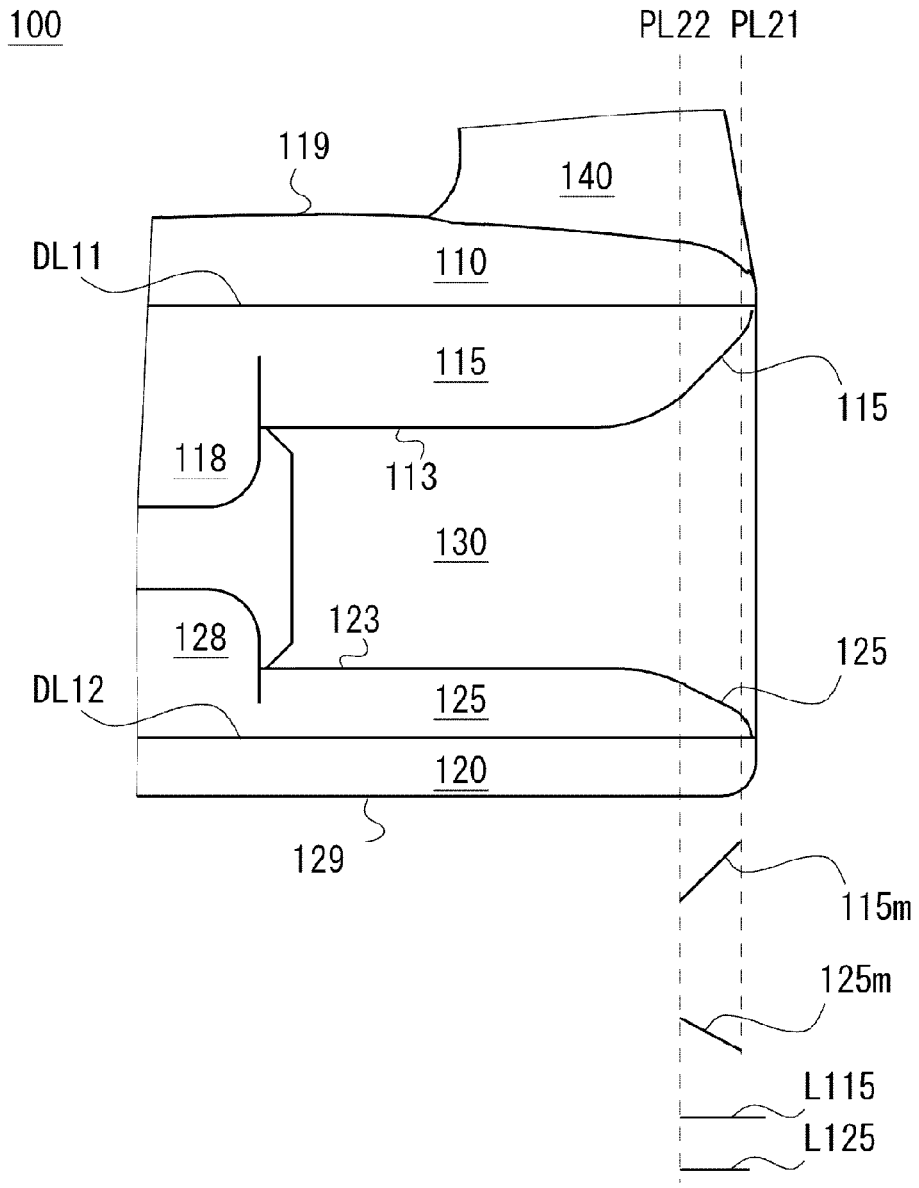
FIG. 4 is a schematic partially expanded view of a right side view of a slider for slide fastener according to the first embodiment of the present invention.
Figure 5:
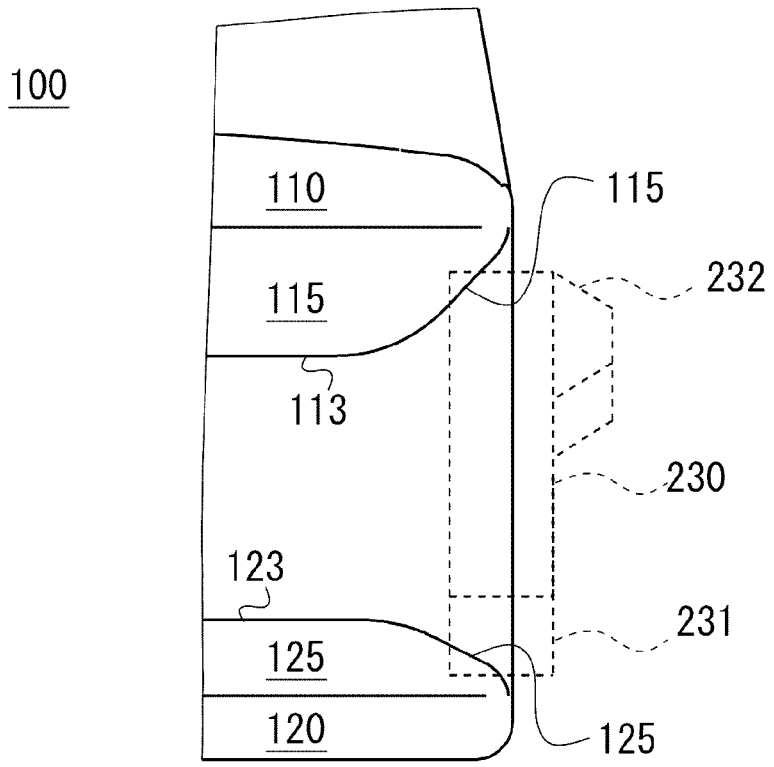
FIG. 5 is a partially expanded view of a right side view of a slider for slide fastener according to the first embodiment of the present invention, schematically illustrating how a fastener element is being guided.
Figure 6:
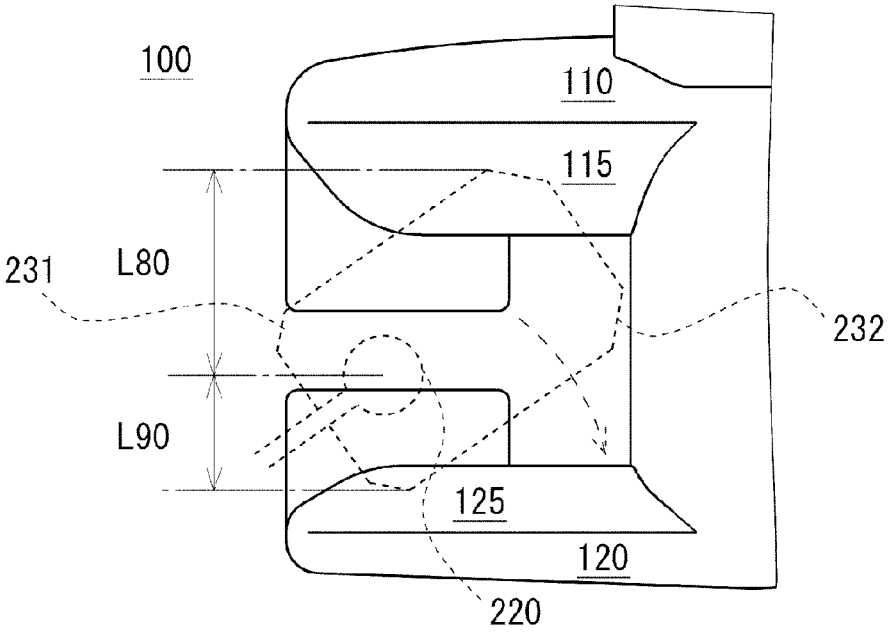
FIG. 6 is a partially expanded view of a schematic front side view of a slider for slide fastener according to the first embodiment of the present invention, schematically illustrating how a fastener element is being guided.
Figure 7:
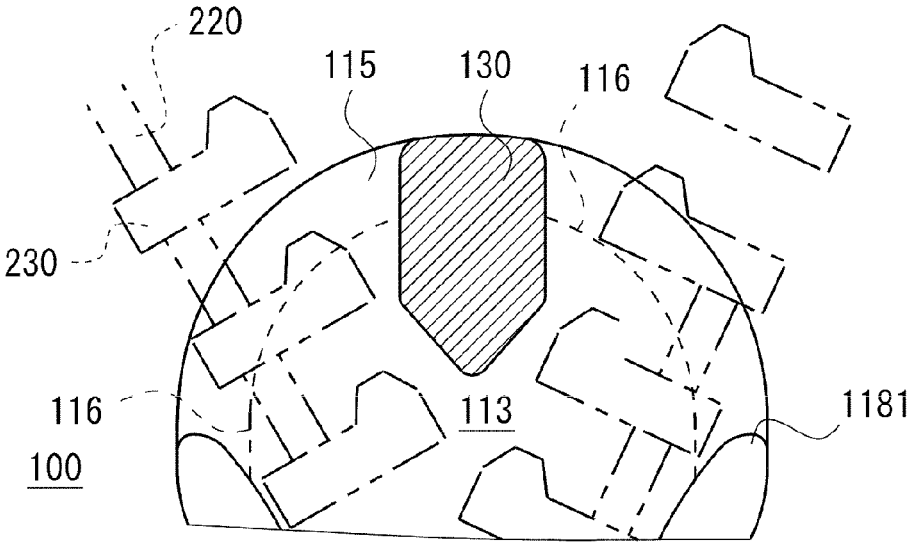
FIG. 7 is a schematic view of an inner surface of an upper wing of a slider for slide fastener according to the first embodiment of the present invention, a coupling pillar being illustrated in section, a border between a slope and a flat surface being illustrated in a broken line and, just for a reference, a fastener element being illustrated in an alternating long and two dots line.
Figure 8:
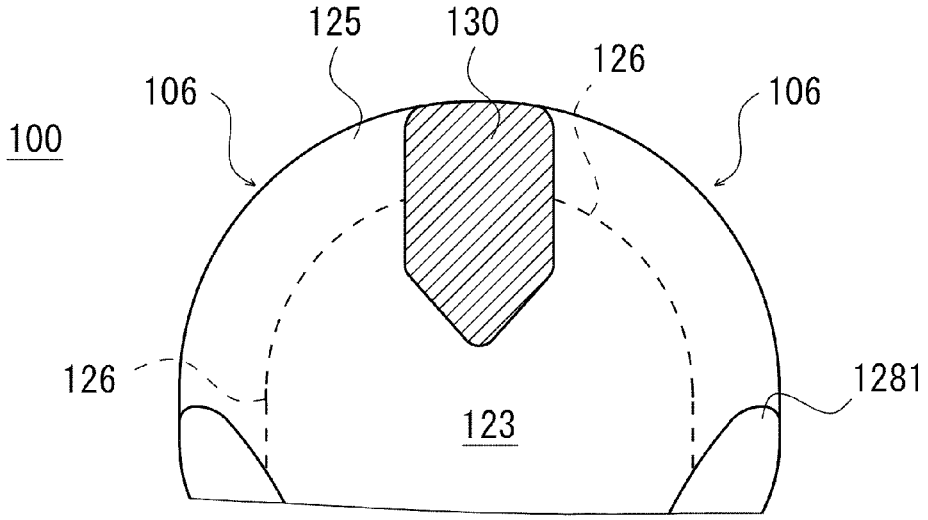
FIG. 8 is a schematic view of an inner surface of a lower wing of a slider for slide fastener according to the first embodiment of the present invention, a coupling pillar being illustrated in section, and a border between a sloped surface and a flat surface being illustrated in a broken line.

A first embodiment will be described with reference to FIGS. 1-8. FIG. 1 is a schematic front view of a slide fastener including a slider for slide fastener. FIG. 2 is a schematic right side view of a slider for slide fastener. FIG. 3 is a schematic front side view of a slider for slide fastener. FIG. 4 is a schematic partially expanded view of a right side view of a slider for slide fastener. FIG. 5 is a partially expanded view of a right side view of a slider for slide fastener, schematically illustrating how a fastener element is being guided. FIG. 6 is a partially expanded view of a schematic front side view of a slider for slide fastener, schematically illustrating how a fastener element is being guided. FIG. 7 is a schematic view of an inner surface of an upper wing of a slider for slide fastener, a coupling pillar being illustrated in section, a border between a slope and a flat surface being illustrated in a broken line and, just for a reference, a fastener element being illustrated in an alternating long and two dots line. The inner surface of the upper wing is a surface that faces the lower wing. FIG. 8 is a schematic view of an inner surface of a lower wing of a slider for slide fastener, a coupling pillar being illustrated in section, and a border between a sloped surface and a flat surface being illustrated in a broken line. The inner surface of the lower wing is a surface that faces the upper wing. The inner surface of the lower wing and the inner surface of the upper wing define a passage for fastener element at a slider body. So, these inner surfaces may be referred to as an inner surface of the passage.

A slide fastener 500 according to a first embodiment of the present invention includes, as illustrated in FIG. 1, a pair of fastener stringers 200 extending in the front-back direction and arranged in parallel in the left-right direction, and a slider 100 which is moveable in the front-back direction along the left and right opposed edges of the pair of fastener stringers 200. If the slider 100 is moved frontward, the pair of fastener stringers 200 may be closed. If the slider 100 is moved backward, the pair of fastener stringers 200 may be opened. Note that the up-down direction, the left-right direction and the front-back direction in FIG. 1 correspond to those in FIGS. 2 and 3. That is, the frontward is equal to the up side in FIG. 1, and the backward is equal to the bottom side in FIG. 1. The upward is equal to the near side of the paper of FIG. 1, and the downward is equal to the far side of the paper of FIG. 1. The rightward is equal to the right side in FIG. 1, and the leftward is equal to the left side in FIG. 1.

As shown in FIG. 1, the respective fastener elements 230 of the left-right pair of fastener stringers 200 may be inserted through the slider 100 so that the slider 100 according to the present disclosure may be embedded in the slide fastener 500. Note that, any type of slide fastener 500 may be used, and the fastener element should not be limited to the metal fastener elements shown in FIG. 1, but it may be resin molded fastener elements. In some cases, coil fastener elements formed by monofilament being shaped into a coil-like may be employed. Note that, in the metal fastener elements or resin fastener elements, a number of fastener elements are arranged and separated along the front-back direction, and each fastener element may take its own orientation in accordance with the orientation of a fastener tape or a member to which the fastener tape is stitched, a leather for example. On the other hand, the coil element may be shaped like a coil which continuously extends in the front-back direction and may be stitched to the opposed edge of a fastener tape. The orientation of the coil element may continuously change along the front-back direction in accordance with the orientation of a fastener tape or a member to which the fastener tape is stitched, a leather for example. In either case, the slider 10 for slide fastener according to the present invention may be effective, but more evident technical effect may be observed when being utilized together with the metal fastener element. This may be because a metal fastener element may be harder in its material and may have a shape which may easily serve as an obstacle compared to a resin fastener element or coil fastener element. The metal fastener element may easily hit against the front surface of the upper wing of a slider as the opposed edge of the fastener element is not much chamfered The slider 100 may typically preferably be made of a metal, and may be mass-produced through a die-casting. However, it may be mass-produced through other processes. For example, it may be made of a resin and may be produced through an injection molding.

As shown in FIG. 1, the slide fastener 500 includes a left-right pair of fastener stringers 200. The left-right pair of fastener stringers 200 includes a left-right pair of fastener tapes 210. The fastener tape 210 may be a flat web or knit elongated in the front-back direction and having a given width in the left-right direction. Its front and back ends may be reinforced by a resin film for reinforcement. The opposed edges of the left-right pair of fastener tapes 210 are provided with core threads 220, respectively. The core thread 22 may be a portion provided at the opposed edge of the fastener tape 210 and enlarged to be circular shape in section. Each core threads 220 at the left and right fastener tapes is provided with a fastener element 230 of a left-right pair of fastener elements 230. The fastener element 230 may include a base 231 which is an end attached to the core thread 220, and a head 232 which is arranged at the free end opposite to the base 231. The fastener element 230 extends in the left-right direction with a given front-back width, and has a frontward projection at the head 232.

When the slider 100 is moved frontward under a state in which the left-right pair of fastener elements 230 are inserted into the slider 100, the separated left and right fastener elements 230 may couple together and the left-right pair of fastener stringers 200 may be closed. When the slider 100 is moved backward, the coupled left and right fastener elements 230 may be separated and the left-right pair of fastener stringers 200 may be opened. The head 232 of the fastener element 230 may be provided with a projection at front side, and a recess at back side opposite to the front side. By the frontward movement of the slider 100 for slide fastener, the head 232 of a fastener element 230 at one side of the fastener stringer 200 may be inserted and interposed between two fastener elements 230 at the other side of fastener stringer 200. Under this situation, the head 232 may engage with the recess at the head 232 of the front-side fastener element 230 and may engage with the projection at the head 232 of the back-side fastener element 230. This phenomenon may continuously apply in the forward direction so that the coupling between paired left and right fastener elements 230 may be achieved. The backward movement of the slider 100 may create a widened space between the left and right fastener elements 230 and decouple them.

Front stops 240 may be provided adjacent to the front end of the left and right fastener element lines of the fastener elements 230. A separable stop 250 may be provided adjacent to the back ends of the fastener element lines. The front stop 240 may typically be sized to allow partial insertion thereof into the slider 100 but not to allow complete passing through the slider 100, thereby running-off of the slider 100 may be prevented.

The separable stop 250 may include a box 251, a box bar 252, and a butterfly bar 253. The box bar 252 may be integrally coupled to the box 251. The butterfly bar 253 may be inserted into a right front mouth of the slider 100 positioned in front of the box 251 so that the box bar 252 and the butterfly bar 253 may be aligned. By the frontward movement of the slider 100, the left and right fastener elements 230 can couple together.

The slider 100 may be configured such that a pull attachment post 140 is provided on the upper surface of a slider body 105. The pull attachment post 140 is not a requisite and may possibly be omitted. The slider body 105 may include an upper wing 110, a lower wing 120, and a coupling pillar 130 that couples the upper wing 110 and the lower wing 120 at the front side and at the center in the left-right direction, as shown in FIGS. 2-4. The slider body 105 may have a left-right pair of front mouths 106 at the front side sandwiching the coupling pillar 130 and one back mouth 107 at the back side opposite to the front side. The slider body 105 may have a passage, bifurcated by the coupling pillar 130, for the left-right pair of fastener elements between the upper wing 110 and the lower wing 120.

The upper wing 110 may be a plate being narrowed in the left-right direction at the backward compared to the frontward, and may include a front part 111 where the top end of the coupling pillar is coupled at the center in the left-right direction and a back part 112 at the opposite side of the front part 111. The upper wing 110 may further include a left-right pair of upper flanges 118 projecting toward the lower wing 120 at the backward at the both left and right sides. The upper wing 110 may have an inner surface 113 which is flat between the front part 111 and the back part 112. Furthermore, the upper wing 110 may have a top surface 119 which is gradually raised toward the center from both sides in left and right direction and which is chamfered to be a round surface at the circumference.

Similar to the upper wing 110, the lower wing 120 may be a plate being narrowed in the left-right direction at the backward compared to the frontward. The lower wing 120 may include a front part 121 where the bottom end of the coupling pillar is coupled at the center in the left-right direction, and a back part 122 at the opposite side of the front part 121. The lower wing 120 may further include a left-right pair of lower flanges 128 projecting toward the upper wing 110 at the backward at the left and right sides. The lower wing 120 may have an inner surface 123 which is flat between the front part 121 and the back part 122. This inner surface 123 faces the inner surface 113 of the upper wing 110. The inner surface 123 of the lower wing 120 is arranged to be opposed to the inner surface 113 of the upper wing 110 in parallel. A passage for fastener elements 230 may be provided between the inner surface 113 of the upper wing 110 and the inner surface 123 of the lower wing. The fastener elements may slide on the inner surface 123 of the lower wing 120 or the inner surface 113 of the upper wing 110. Note that the lower wing 120 may have a bottom surface 129 which may be substantially flat but may be chamfered to be a round surface at the circumference.

The upper flange 118 and the lower flange 128 are configured to be symmetry in the up-down direction. The left and right upper flanges 118 may extend away from the front mouth 106 of the slider body 105 toward the back mouth 107 such that the passage for fastener elements 230 may be restricted from the left and right sides. The left and right lower flanges 128 may extend away from the front mouth 106 of the slider body 105 toward the back mouth 107 such that the passage for fastener elements 230 may be restricted from the left and right sides. As understood from FIG. 2, the front end 1181 of the upper flange 118 and the front end 1281 of the lower flange 128 are positioned backward from the coupling pillar 130 so that the left and right front mouths 106 having a wider width are provided at the slider 100. Note that, at the back mouth 107 side of the slider 100, the upper flange 118 may have a back end 1182 and the lower flange 128 may have a back end 1282.

The up-down distance between the inner surface 113 of the upper wing 110 and the inner surface 123 of the lower wing 120 may be appropriately set in order to ensure smooth movement of fastener elements 230 inside the slider. If the up-down distance between the inner surface 113 of the upper wing 110 and the inner surface 123 of the lower wing 120 was too wide, the fastener elements 230 may more easily enter into the slider, but the up-down displacement of fastener element 230 inside the slider may not be sufficiently restricted, possibly making it difficult to ensure steady movement of fastener elements 230 inside the slider.

In the present invention, as shown in FIGS. 2-4, there may be provided a left-right pair of downward slopes 115 at the front part 111 of the upper wing 110. The left-right pair of downward slopes 115 are provided at the left and right sides of the coupling pillar 130 to sandwich the coupling pillar 130. The left-right pair of downward slopes 115 descend toward the lower wing 120 as extending away from the front mouth 106 toward the back mouth 107 of the slider body 105. Furthermore, there may be provided a left-right pair of upward slopes 125 at the front part 121 of the lower wing 120. The left-right pair of upward slopes 125 are provided at the left and right sides of the coupling pillar 130 to sandwich the coupling pillar 130. The left-right pair of upward slopes 125 ascend toward the upper wing 110 as extending away from the front mouth 106 toward the back mouth 107 of the slider body 105. The up-down distance between the downward slope 115 and the upward slope 125 may gradually decrease as being away from the front mouth 106 and being closer to the back mouth 107 in the slider body 105. Still further, the downward slope 115 at the upper wing 110 may be steeper than the upward slope 125 at the lower wing 120.

As understood from FIGS. 5-6, the head 232 positioned far from the core thread 220 may possibly upwardly or downwardly rotate around the center of the core thread 220 which is assumed to have a circular shape. However, according to above configuration, especially when the slide fastener is to be closed and the slider 100 is to be moved frontward, the head 232 of the fastener element 230 may rotate upwardly but the head 232 may be relatively suddenly pushed down by the steeper downward slope 115 at the time of entering. On the other hand, the base 231 adjacent to the core thread 220 may be gradually pushed up by the upward slope 125 which is a more moderate slant than the downward slope 115 at the time of entering. Accordingly the rotation of the fastener element 230 may be suitably facilitated so that the fastener element 230 can escape from a tilted state in which the head 232 is tilted as shown in FIG. 6 and can take an orientation whereby the head 232 can enter into the space between the inner surface of the upper wing 110 and the inner surface of the lower wing 120. The head 232 of the fastener element 230 may be gradually downwardly pushed by the downward slope 115 as the head 232 downwardly sliding on the downward slope 115 and the base 231 of the fastener element 230 may be gradually upwardly pushed by the upward slope 125 as the base 231 upwardly sliding on the upward slope 125, resulting in that the fastener element 230 as a whole may rotate in clockwise as indicated by a dotted arrow in FIG. 6.

In a case of patent literature 1, the inner surface of the front part 111 of the upper wing 110 is provided with an upper slope and the inner surface of the front part 121 of the lower wing 120 is provided with a lower slope. However, the gradients of these slopes are substantially identical, and thus it was not possible to sufficiently correct the orientation of the fastener element 230 for the uses where decreased exposure of fastener tape is demanded as a recent trend.

As stated at the beginning as an example, when the fastener tape is stitched to a leather which has a given thickness and lower flexibility compared to the fastener tape, the interspace between the fastener element line and the leather may tends to be narrower for the sake of improved appearance. Thus, the fastener elements may be oriented in accordance to the orientation of the leather portion to which the fastener tape is stitched without enjoying the benefit of flexibility of fastener tape. This problem may be particularly evident when a slider fastener is to be arranged to the upper edges of two vertically oriented standing leathers, unlike the slider fastener is to be arranged to the two laterally horizontally laying leathers. The fastener elements may be vertically oriented in accordance with the vertical orientation of the leather.

According to the present invention, as described above, the downward slope 115 may actively push down the head 232 of the fastener element 230 to facilitate the rotation of the fastener element 230. In a preferred embodiment, the upward slope 125 may support that rotation of the fastener element. Accordingly, a slider may be provided which may allow various stitching manners of fastener tape including the above examples. Note that, in a case of FIG. 6, the distance L80 between the uppermost point of the head 232 and the center of the core thread 220 may be greater than, and roughly twice of the distance L90 between the lowermost point of base 231 and the center of the core thread 220.

Following conditions may be satisfied preferably, not a requisite though. As shown in FIG. 4, a first parting line DL11 may exist at the side surface of the upper wing 110, and a second parting line DL12 may exist at the side surface of the lower wing 120. Note that, a parting line may be a line formed at the boundary of the distinct molds when they are matched. The parting line may be understood to be existing in one of planes orthogonal to the coupling pillar 130.

The first parting line DL11 may exist in one of planes orthogonal to the coupling pillar 130. As shown in FIG. 2, the angle θ1 of the downward slope 115 relative to that plane or any other parallel plane is set. The second parting line DL12 may exist in one of planes orthogonal to the coupling pillar 130. As shown in FIG. 2, the angle θ2 of the upward slope 125 relative to that plane or any other parallel plane is set. At this instance, $1.5 \leq \theta1/\theta2 \leq 2$ may be satisfied, preferably.

When $\theta1/\theta2<1.5$ is satisfied, it may be expected that sufficient downward displacement of the head 232 of the fastener element 230 by the downward slope 115 may not be facilitated. In contrast, when $2<\theta1/\theta2$ is satisfied, the thickness of the upper wing 110 may be greater unnecessarily, possibly deteriorating the manipulation of the slider 100 and deteriorating the appearance of the slider 100. If the thickness of the upper wing 110 becomes so greater, the position of the pull attachment post 140 may be higher, and a moment applied to the slider by the manipulation of the slider may change. By satisfying the above conditions, these problems may be remedied and the rotation of the fastener element 230 may be preferably facilitated. Note that, in FIG. 2, a plane PL1 is schematically illustrated which is parallel to the first parting line DL11 and a plane PL2 is schematically illustrated which is parallel to the second parting line DL12.

Note that the first parting line DL11 and the second parting line DL12 are in parallel one another, and thus the second parting line DL12 may be referenced instead of the first parting line DL11, and the first parting line DL11 may be referenced instead of the second parting line DL 12. A case where only one parting line exists is also assumed and, in this case one of the first parting line DL11 and the second parting line DL12 may be omitted. Alternatively, both of them may be omitted and another parting line arranged differently may be referenced.

Preferably, θ1 may be equal to or greater than 40° and equal to or less than 60°, and θ2 may be equal to or greater than 20° and equal to or less than 40°. More preferably, θ1 may be equal to or greater than 45° and equal to or less than 55°, and θ2 may be equal to or greater than 25° and equal to or less than 35°. Still more preferably, θ1 may be equal to 50°, and θ2 may be equal to 30°. The planes where inner surface 113 of the upper wing 110 or the inner surface 123 of the lower wing exist or other planes in parallel thereto may be referenced instead of the planes where the first parting lineDL11 or the second parting line DL 12 exist or other planes in parallel thereto. Alternatively, any other plane orthogonal to the extending direction of the coupling pillar 130 may be referenced instead. In either case, similar description will apply.

Following conditions may preferably be satisfied additionally or alternatively to the above conditions. As shown in FIG. 3, at the both right and left sides, the distance TH115 between the top and bottom end points of the downward slope 115 along the thickness direction of the upper wing 110 is greater than the distance TH125 between the top and bottom end points of the upward slope 125 along the thickness direction of the lower wing 120, i.e. Distance TH115>Distance TH125 is satisfied. The distance TH115 may be set greater than the distance TH125 so that the downward slope 115 may be elongated in the front-back direction and to be steeper.

FIG. 3 shows a plane PL115*a* where the top end point of the downward slope 115 exists, and a plane PL115*b* where the bottom end point of the downward slope 115 exists. Further disclosed are a plane PL125*a* where the top end point of the upward slope 125 exists, and a plane PL125*b* where the bottom end point of the upward slope 125 exists. The planes PL115*a*, PL115*b*, PL125*a*, and PL125*b* are orthogonal to the up-down direction which is equal to the extending direction of the coupling pillar 130, and are in parallel one another.

The top end or the top end point of the downward slope 115 may be an upward terminal or upward terminal point of the downward slope 115. If a border line or a border edge is seen between the downward slope 115 and an adjacent upward surface of the upper wing 110, this position of the border line or the border edge may be referenced as the top end point of the downward slope 115. In the illustrated case, the top end point of the downward surface 115 may be the position of the border edge between the downward slope 115 and an intermediate surface between the downward slope 115 and the top surface 119. If the boarder edge has the up-down width, any location within this width may be referenced as the top end point of the downward slope 115. The uppermost or lowermost point within the up-down width of the border edge may be referenced as the top end point of the downward slope 115.

The bottom end or the bottom end point of the downward slope 115 may be a downward terminal or downward terminal point of the downward slope 115. If a border line or a border edge is seen between the downward slope 115 and an adjacent downward surface of the upper wing 110, this position of the border line or the border edge may be referenced as the bottom end point of the downward slope 115. In the illustrated case, the bottom end point of the downward surface 115 may be the position of the border edge between the downward slope 115 and the inner surface 113. If the boarder edge has the up-down width, any point within this width may be referenced as the bottom end point of the downward slope 115. The uppermost or lowermost point within the up-down width of the border edge may be referenced as the bottom end point of the downward slope 115.

The top end or the top end point of the upward slope 125 may be an upward terminal or upward terminal point of the upward slope 125. If a border line or a border edge is seen between the upward slope 125 and an adjacent upward surface of the lower wing 120, this position of the border line or the border edge may be referenced as the top end point of the upward slope 115. In the illustrated case, the top end point of the upward surface 125 may be the position of the border edge between the upward slope 125 and the inner surface 123. If the boarder edge has the up-down width, any point within this width may be referenced as the top end point of the upward slope 125. The uppermost or lowermost point within the up-down width of the border edge may be referenced as the top end point of the upward slope 125.

The bottom end or the bottom end point of the upward slope 125 may be a downward terminal or downward terminal point of the upward slope 125. If a border line or a border edge is seen between the upward slope 125 and an adjacent downward surface of the lower wing 120, this position of the border line or the border edge may be referenced as the bottom end point of the upward slope 125. In the illustrated case, the bottom end point of the upward surface 125 may be the position of the border edge between the upward slope 125 and the intermediate surface between the bottom surface 129 and the upward slope 125. If the boarder edge has the up-down width, any point within this width may be referenced as the bottom end point of the upward surface 125. The uppermost or lowermost point within the up-down width of the border edge may be referenced as the bottom end point of the upward surface 125.

In a case where the distance TH115>the distance TH125 is satisfied, the distance TH115 may be equal to or greater than 1.0 mm and equal to or less than 2.0 mm, and the distance TH125 may be equal to or greater than 0.5 mm and equal to or less than 1.0 mm, not necessarily limited thereto though.

In a preferred illustrated embodiment, the maximum thickness TH110 of the upper wing 110>the maximum thickness TH120 of the lower wing 120 may be satisfied. By the increase in thickness of the upper wing 110, the steepness and sufficient downward slope length of the downward slope 115 may be ensured.

With respect to normal sliders 100, conventionally, the thicknesses of the upper wing 110 and the lower wing 120 have been set to be equal. Thus, as it was, even for the present inventor, changing the thickness between the upper wing 110 and the lower wing 120 was not a promising option. However, the downward slope 115 may be better to be steeper in order to ensure the above-described downward reorientation of the head 232 of the fastener element 230 by the downward slope 115. The increase in the thickness of the upper wing 110 may be effective in ensuring the sufficient length of the steeper downward slope 115. Thus, as described above, the maximum thickness TH110 of the upper wing 110>the maximum thickness TH120 of the lower wing 120 may be satisfied.

It is assumed that an additional structure may be given to the upper wing 110 or the lower wing 120 to intentionally change the maximum thickness thereof. In view of this scenario, the following more essential condition may be satisfied, the distance TH115 between the top and bottom end points of the downward slope 115 along the thickness direction of the upper wing 110>the distance TH125 between the top and bottom end points of the upward slope 125 along the thickness direction of the lower wing 120.

Additionally or alternatively to the above various conditions, the following condition may be satisfied, more preferably. That is, the length of the downward slope 115 is greater than the length of the upward slope 125, preferably. The length of the downward slope 115 may be the length of the downward slope 115 in the downward direction. The length of the upward slope 125 may be the length of the upward slope 125 in the upward direction. It may be expected that the head 232 of the fastener element 230 may be more sufficiently pushed down by the downward slope 115 which is steeper and elongated in the front-back direction.

Regarding this feature, further supplemental descriptions will be made with reference to FIG. 4. As shown in FIG. 4, a pair of planes PL21, PL22 are recognized which are vertical to the first parting line DL11 and the second parting line DL12 and are separated in the front-back direction. By the pair of planes PL21, PL22, a part 115*m* of the downward slope 115 may be cut out and a part 125*m* of the upward slope 125 may be cut out. The length L115 of the part 115*m* of the downward slope 115 may be greater than the length L125 of the part 125*m* of the upward slope 125. This may prove that the length of the downward slope 115 is greater than the length of the upward slope 125.

In a preferred illustrated embodiment, as particularly shown in FIG. 7, each of the left-right pair of downward slopes 115 is provided to have a constant gradient and to have a constant length across a region at least between the coupling pillar 130 and the upper flange 118. It is expected that more uniform orientation control may be given to the fastener element 230 which may possibly take variable orientation relative to the front mouth 106 of the slider 100. The same holds true for the lower wing 120. As particularly shown in FIG. 8, each of the left-right pair of upward slopes 125 is provided to have a constant gradient and to have a constant length across a region at least between the coupling pillar 130 and the lower flange 128. Similar effect may be obtained.

As shown in FIG. 7, the left-right pair of downward slopes 115 may present a U-shape divided by the coupling pillar 130. When viewed in front, the left downward slope 115 and the right downward slope 115 may extend in a curve toward the upper flange 118 from the left or right side of the coupling pillar 130, and may be symmetrically arranged interposing the coupling pillar 130. The same holds true for the upward slopes 125. As shown in FIG. 8, the left-right pair of upward slopes 125 may present a U-shape divided by the coupling pillar 130. When viewed in front, the left upward slope 125 and the right upward slope 125 may extend in a curve toward the lower flange 128 from the left or right side of the coupling pillar 130, and may be symmetrically arranged interposing the coupling pillar 130. As understandable by comparing the FIGS. 7 and 8, the U-shaped upward slope 125 viewed in front is congruent with the U-shaped downward slope 115 viewed in front. When the fastener element 230 is entering into the passage in the slider body 105, earlier than the base 231, the head 232 of the fastener element 230 may contact the downward slope 115 and in turn its orientation may be corrected. This is because the downward slope 115 and the upward slope 125 extend in a curve. Furthermore, when the entering fastener element 230 advances still further, the base 231 contacts the upward slope 125 so that further correction of orientation may be facilitated. Accordingly, smoother reorientation may be possible.

As understandable by comparing the FIGS. 7 and 8, there is provided an orientation correction region in which the downward slope 115 and the upward slope 125 are provided in an overlapping manner in the up-down direction. The border line 116 between the downward slope 115 and the inner surface 113 and the border line 126 between the upward slope 125 and the inner surface 123 may be symmetrical in the up-down direction. By the border line, the fastener element orientation correction region at the front side and the fastener element guide region at the back side are divided. The fastener element guide region could be referred as a passage for fastener element.

The downward slope 115 and the upward slope 125 may be a metal flat surface and a reflective surface which receives and reflects the light from a light source such as the sun or a fluorescent lighting. The downward slope 115 may have a given angle relative to the inner surface 113, and the upward slope 125 may have a given angle relative to the inner surface 123. Therefore, these surface may be clearly observable as a reflective surface. Note that the reflective surface may include a mirror finished mirrored surface and a rough surface on which no process is performed.

The downward slope 115 may be steep and, on the other hand, the upward slope 125 may be moderate in gradient. Therefore, under one lightning condition, the edge between the downward slope 115 and the inner surface 113 may be more easily observed than the edge between the upward slope 125 and the inner surface 123. Note that the edge between the downward slope 115 and the inner surface 113 may be positioned at the border line 116. The edge between the upward slope 125 and the inner surface 123 may be positioned at the border line 126.

In view of the above teachings, the skilled person could add various modifications to the respective embodiments. The reference numbers introduced in Claims are just for a reference, and should not be referenced for the purpose of narrowly construing claims.

REFERENCE SIGNS LIST

100 Slider for slide fastener
105 Slider body
106 Front mouth
107 Back mouth
110 Upper wing
120 Lower wing
130 Coupling pillar
115 Downward slope
125 Upward slope

The invention claimed is:

1. A slider comprising a slider body in which an upper wing and a lower wing are coupled via a coupling pillar at the front side, the upper wing comprises a pair of upper flanges that are projected toward the lower wing and extend away from a front mouth toward a back mouth of the slider, and a passage being divided by the coupling pillar is provided between the upper wing and the lower wing and is partially defined between the pair of upper flanges, wherein at a front part of the upper wing, downward slopes are provided at the both left and right sides of the coupling pillar, each downward slope descending toward the lower wing as extending away from the front mouth toward the back mouth of the slider body, wherein at a front part of the lower wing, upward slopes are provided at the both left and right sides of the coupling pillar, each upward slope ascending toward the upper wing as extending away from the front mouth toward the back mouth of the slider body, and wherein at each left and right side, the downward slope of the upper wing is steeper than the upward slope of the lower wing.

2. The slider according to claim 1, wherein $1.5 \leq (\theta 1/\theta 2) \leq 2$ is satisfied, wherein $\theta 1$ indicates the angle of the downward slope relative to a plane that is parallel to an inner surface of the passage in the slider body; and $\theta 2$ indicates the angle of the upward slope relative to a plane that is parallel to the inner surface of the passage in the slider body.

3. The slider according to claim 1, wherein a distance between top and bottom end points of the downward slope along a first thickness direction of the upper wing is greater than a distance between the top and bottom end points of the upward slope along a second thickness direction of the lower wing, the first and second thickness directions being parallel to a direction in which the coupling pillar extends.

4. The slider according to claim 1, wherein a length of the downward slope is greater than a length of the upward slope.

5. The slider according to claim 1, wherein each downward slope is provided at a region between the coupling pillar and each upper flange.

6. The slider according to claim 5, wherein the lower wing comprises a pair of lower flanges that extend away from the front mouth toward the back mouth of the slider body, and wherein each upward slope is provided at a region covering at least between the coupling pillar and each lower flange.

7. The slider according to claim 1, wherein the upper wing extends between the coupling pillar and each upper flange.

8. A slide fastener comprising:

the slider according to claim 1, and a pair of fastener stringers opened and closed by the slider.

9. A slider comprising a slider body in which an upper wing and a lower wing are coupled via a coupling pillar at a front side, the upper wing comprises a pair of upper flanges that are protected toward the lower wing and extend away from a front mouth toward a back mouth of the slider, and a passage being divided by the coupling pillar is provided between the upper wing and the lower wing and is partially defined between the pair of upper flanges, wherein at a front part of the upper wing, downward slopes are provided at both left and right sides of the coupling pillar, each downward slope descending toward the lower wing as extending away from the front mouth toward the back mouth of the slider body, wherein at a front part of the lower wing, upward slopes are provided at the both left and right sides of the coupling pillar, each upward slope ascending toward the upper wing as extending away from the front mouth toward the back mouth of the slider body, wherein at each left and right side, the downward slope of the upper wing is steeper than the upward slope of the lower wing, and wherein a distance between top and bottom end points of the downward slope along a first thickness direction of the upper wing is greater than a distance between top and bottom end points of the upward slope along a second thickness direction of the lower wing, the first and second thickness directions being parallel to a direction in which the coupling pillar extends.

* * * * *